United States Patent [19]

Milbauer

[11] 4,353,359

[45] Oct. 12, 1982

[54] PORTABLE JACKET FOR TREATMENT AND PROTECTION OF INJURED BODY MEMBERS

[76] Inventor: Nathaniel A. Milbauer, 177 Frederick Pl., Bergenfield, N.J. 07621

[21] Appl. No.: 57,952

[22] Filed: Jul. 16, 1979

[51] Int. Cl.[3] ..... A61H 33/00

[52] U.S. Cl. ..... 128/66; 128/402

[58] Field of Search ..... 128/66, 375, 201.29, 128/202.11, 202.19, 399, 400, 402, 298, 299; 150/2.2, 2.4; 2/2.1 A, 2 R

[56] References Cited

U.S. PATENT DOCUMENTS

| | | | |
|---|---|---|---|
| 3,348,236 | 10/1967 | Copeland | 2/2 R |
| 3,477,424 | 11/1969 | Tracy | 128/66 |
| 3,738,367 | 6/1973 | Hardy | 128/400 |
| 3,859,982 | 1/1975 | Dove | 128/298 |
| 4,003,371 | 1/1977 | Fischer | 128/299 |
| 4,107,509 | 8/1978 | Scher et al. | 128/402 |
| 4,139,004 | 2/1979 | Gonzulez | 128/400 |

*Primary Examiner*—Hiram Bernstein

*Attorney, Agent, or Firm*—Arnold D. Litt

[57] ABSTRACT

A protective garment segment is provided which is made of flexible, water-resistant plastic material which is skin compatible, the protective garment segment defining an elongated hollow cavity adapted to surround a body member inserted theren; the garment segment comprises a closed end and a limb-receiving sleeve end through which a body member can be inserted; the sleeve end is provided with sealing means so that a water tight garment to body seal can be effected; the garment is provided with means for introducing liquid flow into the interior of the garment so that the limb inserted therein can be bathed and treated with said liquid; means are provided for distributing the liquid through tubes extending throughout the interior of the jacket. Means are also provided to allow the joining of garment segments, with the ultimate capability of joining limb segments to a torso segment resulting in a plastic suit, covering the entire body from the neck down. Means are provided to unify the flow of liquid to all portions of the body garment.

18 Claims, 13 Drawing Figures

PORTABLE JACKET FOR TREATMENT AND PROTECTION OF INJURED BODY MEMBERS

BACKGROUND OF THE INVENTION

1. Field of the Invention

The present invention relates generally to a novel and improved garment or protective covering for the treatment and protection of injured body members.

2. Prior Art

In the past, victims who sustained injuries to various portions of their bodies, as, for example, through traumatic impact or as a result of sustaining burns, have been unable to obtain on-the-scene treatment to maintain the status quo pending the transmitting and arrival of the victim to the hospital. In the case of burn victims, for example, they are presently treated by wrapping the wounded area in cloth dressings until arrival at the hospital. Long term prescribed treatment for burn victims include frequent removal of the cloth dressing and replacement thereof as well as frequent baths preceded by removal of the dressing and the rewrapping thereof after the bath is given. This has proven to be extremely uncomfortable to the patient and presents a substantially greater chance of infection due to continual exposure of the traumatized area. In addition, the frequent changing of cloth dressings has resulted in substantial cost escalation in the context of treatment of burn victims in general. Furthermore, the required bathing necessitates the moving of the victim to the bathing facility which also increases the discomfort to the patient.

Attempts have been made in Prior Art processes, to generate portable equipment which could be brought to the bedside of the patient and which could be utilized to bathe the patient without the required removal to a bathing area. These processes and garments utilized therein have proven unsatisfactory because of the complexity and bulk of the equipment needed as well as the costs in utilizing and operating the same. Noting the problems existent in the Prior Art, the instant invention as defined hereinbelow represents an advancement over the Prior Art in that it allows the patient to remain at one specific location during treatment. No movement of the body is necessitated for different types of treatment. In the case of burn victims, treatment comprising bathing the burned limb or portion of the victim's body with a desired liquid flow, can be accomplished at bedside or in the field without the necessity of removing the patient to a bathing area. The need for removal and rewrapping various cloth dressings over the wound area, is no longer required thereby resulting in substantial cost savings and diminishing the chance of infection to the wound area. The instant invention also contemplates the utilization of flexible plastic materials to fabricate the protective garments so that they can be condensed into small packages prior to use which facilitates their distribution and storage. In addition, the low cost of manufacturing this garment results in the garments themselves being readily disposable after use. The sterile garments can be sold in flexible easy-open packages which need only be opened at the time of placement on the victim.

Reference is made to U.S. Pat. No. 3,477,424 issued Nov. 11, 1969 to T. H. Tracy, entitled "Mobile Hydrotherapy Equipment". This reference relates to a bedside hydrotherapy equipment including a mobile cabinet providing sources of cold and hot liquid, a remote portable sleeve compartment having transparent flexible film walls and associated inflatable bladder means for expanding the compartment walls to maintain the internal volume of the compartment around a body member inserted and sealed water-tight in the compartment, together with connecting conduits with associated valves so that liquid may be circulated through the compartments selectively from and to either of the sources. Aeration is provided to the compartment in cross flow relation to the liquid flow through the compartment to provide whirlpool effects. The teachings of this reference are distinguishable from the instant invention in that the patentee teaches a chamber which defines a rigid, non-flexible system. This is to be distinguished from the instant invention wherein the garment is a nonrigid, flexible transparent system, in one embodiment. The garment can also be fabricated of material to allow passage of UV and infra red rays through it. In fact, one aspect of the utility of the instant invention relates to its ease of storage, disposability, extreme portability and rapid set-up and use whether at bedside or at the place where the injury was first incurred. In addition, the patentee teaches the construction of a double wall which may be inflated to give support to the structure. This requires an air pressure means which is absent and unneeded in the instant invention in view of the unique sealing means, making a water-tight connection. Furthermore, the patentee teaches a chamber which comprises two pieces as opposed to the invention which, at least in one embodiment, may be all in one piece. Finally, the instant invention in one aspect, comprises a modularized plastic suit wherein the various garments surrounding the limbs and torso may be used independently or joined through garment-to-garment sealing devices to provide a uniform protective treatment suit capable of permitting uniform flow of liquid over the entire affected body members.

SUMMARY OF THE INVENTION

The instant invention relates to a protective garment segment which may be utilized independently or in conjunction with other protective garment segments to form a protective covering for victims suffering from traumatic injuries to all or part of their body.

The invention, in a preferred embodiment, finds substantial utility in the treatment of burn victims wherein a protective garment segment made of a flexible, water resistant, transparent plastic material which is skin compatible is utilized. The protective garment segment defines an elongated hollow cavity which is adapted to surround a body member inserted therein; this garment segment comprises a closed end and a limb-receiving sleeve end through which a body member can be inserted. The sleeve end comprises a garment to body sealing ring which permits a water-tight seal between the garment segment and the body member inserted therein, flexible elastic plastic to permit accomodation of the sleeve to different sized body members, and means for removing said sealing ring and said elastic plastic from said sleeve end thereby exposing a garment to garment sealing ring, designed to permit water-tight, air-tight joinder of said garment segment to a second garment segment brought into contact therewith. The garment segment finds utility both as a protective covering to an injured limb, pending transportation of the victim to a suitable hospital, and as a container source for introducing various liquid flows including aerosols at ambient pressure to the affected portions of the victim's body thereby providing therapeutic bathing thereof. In the latter circumstance, any suitable pump means is contemplated for introducing liquid flow into the garment segment. Means are provided in the garment for distributing the liquids throughout thereby uniformly bathing the particular body member in the liquid. Means are also provided for removing the liquid from the garment segment. However, it is emphasized that the garment itself can be used without the necessity of any liquid flow passing there through. The garment in this embodiment forms a sterile protective environment.

The liquid distribution means referred to hereinabove comprises in one embodiment of the invention concentric hollow plastic rings which surround the garment segment and are preferably situated below and in close proximity to the garment to garment sealing ring—one ring providing liquid in-take and the other ring providing liquid out-take. A plurality of perforated distribution and out-take tubes are also provided and extend from and perpendicular to the concentric rings; these tubes run throughout the length of the hollow cavity of the garment segment, whereby liquid entering an in-take ring by, for example, said pump means, can be distributed throughout the hollow cavity by means of said perforated in-take and distribution tubes, said liquid being removed from the hollow cavity through said out-take tube and out-take ring.

In one preferred embodiment of the invention, means are provided over various portions of the surface of the garment to allow a treating physician to insert hypodermic needles and the like into the patient. In addition, openings are provided for use in connection with, for example, attachment of electrodes for monitoring the patient, i.e.—for example, heart beat, respiration and the like. These openings are provided with pull-tab seals so that the hollow cavity remains in a sterile condition until the garment is actually used. At this point, the invention envisions removal of the pull-tab seals as and when the physician deems it necessary.

The garment-segment to garment-segment sealing ring comprises a raised surface extending perpendicularly from the garment segment and running around its entire periphery. The raised surface is further characterized by containing a cylindrical projection running about its entire length, said cylindrical member extending out from and substantially perpendicular to the raised surface. The actual sealing takes place by bringing said sealing ring into contact with a sealing ring from a second garment segment, said second garment segment sealing ring differing from the first garment segment sealing ring in that the raised surface contains a cylindrical depression running about the entire periphery of the garment segment, the depression bearing a female-male relationship to the cylindrical projection of the first garment segment raised surface. When the first and second raised surfaces are brought into contact with each other and pressure is applied, the cylindrical projection of the first raised surface fits into the cylindrical depression of the second raised surface, thereby creating a water-tight, air-tight seal between the first and second garment segments. Thus, for example, this sealing technique permits a leg segment to be joined to a torso segment; or, for an arm segment to be joined to a torso segment. It is contemplated that in severe burn cases, for example, which require complete covering of the body of the victim from the neck down, leg and arm segments could be joined to a torso segment thereby resulting in a plastic suit which covers the entire body from the neck down. The patient could then be transported from the scene of the injury to the hospital either with or without utilization of liquid flow throughout the suit. The instant invention also contemplates the use of one or more of the garment segments at the bedside of the patient wherein bathing treatment of the particular injured or burned limb of the patient can be accomplished without moving the patient to another area or without manipulating the injured area by removal of dressings applied thereupon.

The garment to body sealing ring referred to hereinabove comprises a rigid plastic collar possessing an upper edge and a lower edge; an overlapping plastic strip extending out of the plane of the collar and joining the upper edge to the lower edge of the collar; a gripping segment attached to said overlapping strip; a slit in the collar running from the upper edge to the lower edge, thereby resulting in two segments of the collar joined at the lower edge; an elongated plastic strip attached at one end to a portion of the collar near the slit, with the other end of the strip capable of being pulled through the overlapping plastic strip thereby pulling the collar segments closer together, resulting in a diminution in the diameter of the sleeve to which the collar is attached. The nonattached end of the elongated strip has an adhesive area on its underside which, in its resting mode, is covered with an adhesive tab capable of being removed. This enables the operator to select a desired diameter to allow a snug liquid-tight, air-tight fit between the garment and the body member inserted therein while securing the elongated strip to the collar by way of the adhesive thereby preventing slippage. In a preferred embodiment of the invention, small nodes project from either side of the adhesive-carrying end of the elongated strip thereby preventing slippage of the strip back through the overlapping plastic strip.

It is emphasized that other sealing mechanisms may be used in connection with the garment to body seal. Thus, for example, inflatable bladder means may be provided around the periphery of the sleeve so that once a body member is inserted there through a tight seal can be effectuated by introducing air into the bladder thereby causing it to expand and generating the desired seal.

As already indicated above, the garment segments of the instant invention can be used individually or in joined configuration one to the other. So, for example, a torso segment can be joined with arm segments and leg segments whereby a plastic suit environment is generated. The sealing mechanism has already been described hereinabove and is set forth in more detail in reference to the drawings, hereinbelow. One of the problems associated with joining one segment to another is related to maintaining constant liquid flow through each of the segments which are joined. Thus, if liquid is introduced into a torso segment, for example, it is necessary to insure that the liquid will also flow into an arm segment and/or a leg segment before being removed from the suit. To accomplish this end, connector boxes are utilized as a part of the instant invention. In one embodiment of the invention, a connector box of a first garment segment is attached to and extends from the main concentric, hollow, plastic distribution rings by means of connector tubes. The connector box comprises a rectangular housing defining a hollow cavity containing two rigid hollow cylindrically-shaped flow plugs, situated side-by-side. These plugs extend from the connector tubes and terminate within said housing. When the connector box is not being used, the open end thereof is provided with a removable covering to prevent liquid leakage and/or air intrusion, thereby maintaining a sterile environment.

One of the flow plugs described hereinabove is slightly larger than the other flow plug, said plugs acting as conduits for liquid introduction into and liquid withdrawal from the concentric plastic rings. The connector box is adapted to fit into a second connector box situated on another garment segment, the second connector box comprising a rectangular housing of slightly smaller dimensions than that of the first connector box, said housing defining a hollow cavity comprising two rigid, hollow, cylindrically-shaped flow plugs, situated side-by-side, of identical dimensions to the flow plugs of the first connector box but bearing a reversed positioning relative thereto, so that upon insertion of the second connector box into the first connector box, the smaller plug fits into the larger plug of the first connector box, while the larger plug fits over the smaller plug of the first connector box. Locking means are also provided in the connector box whereby the two connector boxes become releasably locked when they are inserted one into the other. Thus, with the connector boxes of this invention, a water-tight, air-tight seal is created enabling liquid flowing through one garment segment to enter and flow through a second garment segment, and, to be removed therefrom.

DETAILED DESCRIPTION OF THE DRAWINGS

With reference first to FIGS. 1 through 5, a preferred embodiment is shown with respect to the plastic segments of the instant invention.

Figure 1:
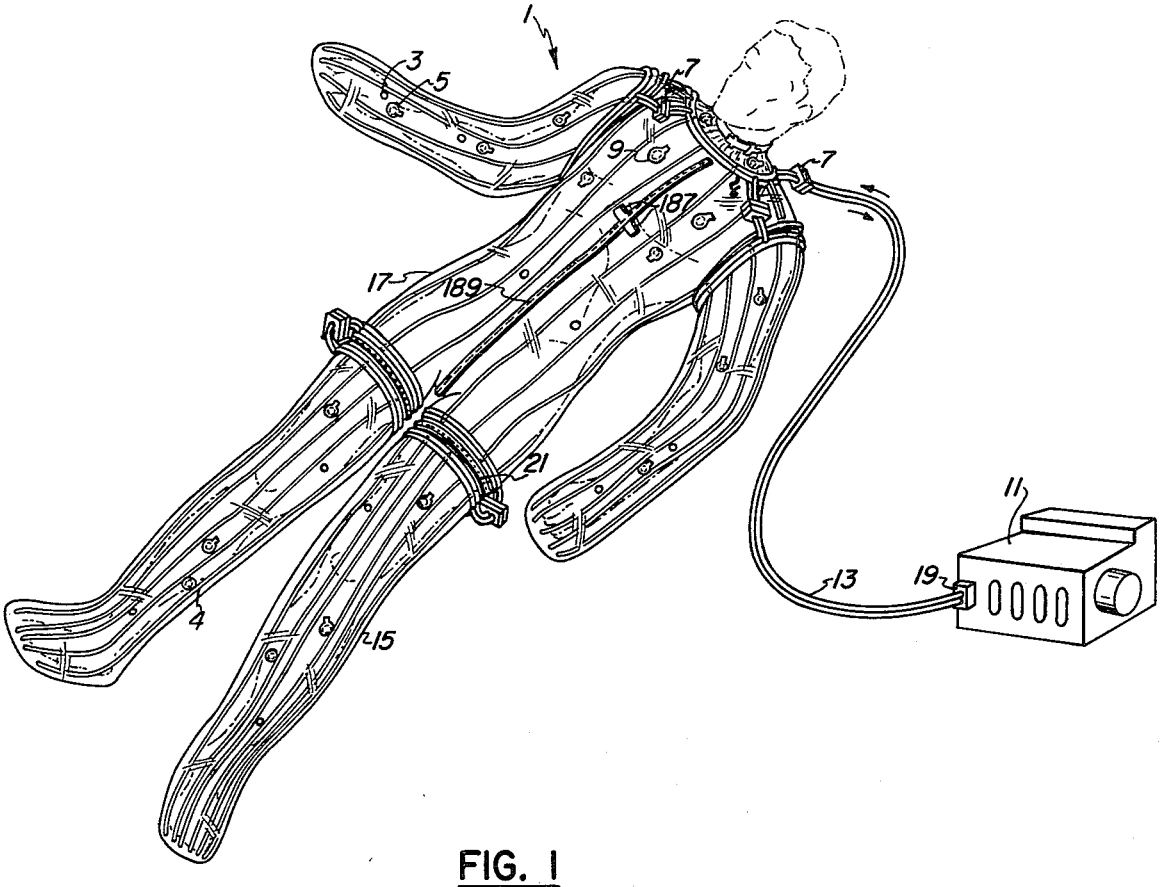
FIG. 1 is a perspective view of a plastic suit.
Figure 2:
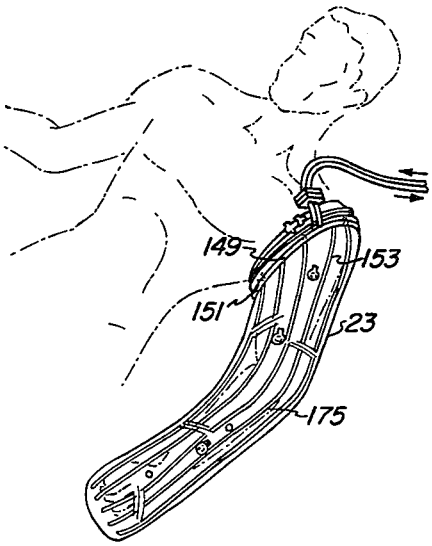
FIG. 2 is a perspective view of the arm segment.
Figure 3:
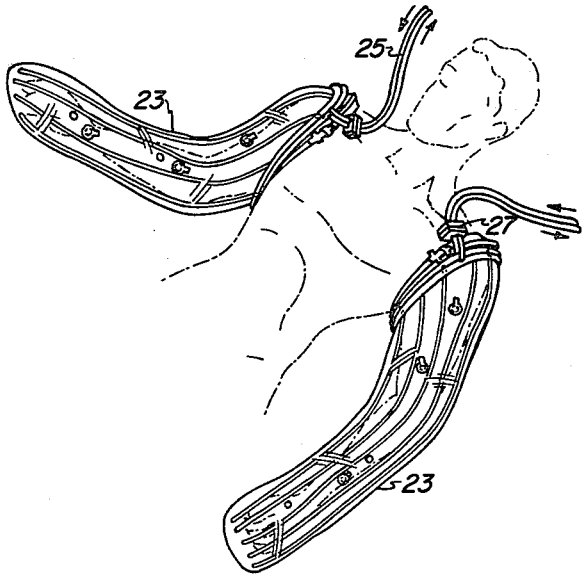
FIG. 3 is a perspective view showing the two arm segments.
Figure 4:
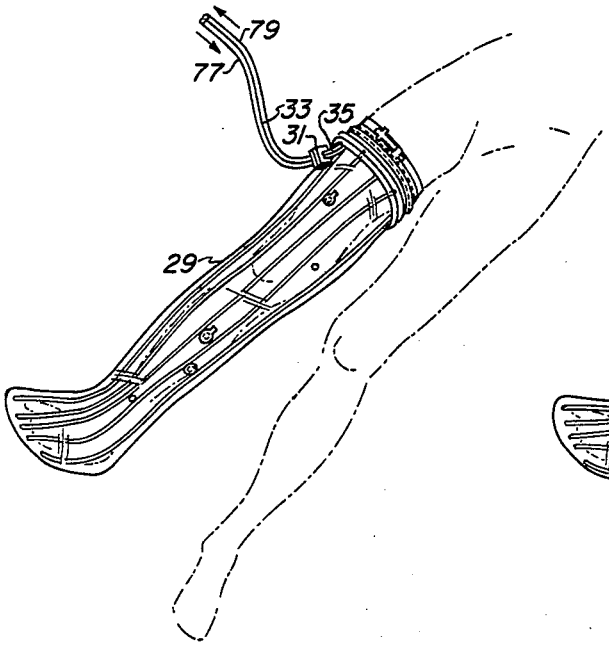
FIG. 4 is a perspective view showing a leg segment.
Figure 5:
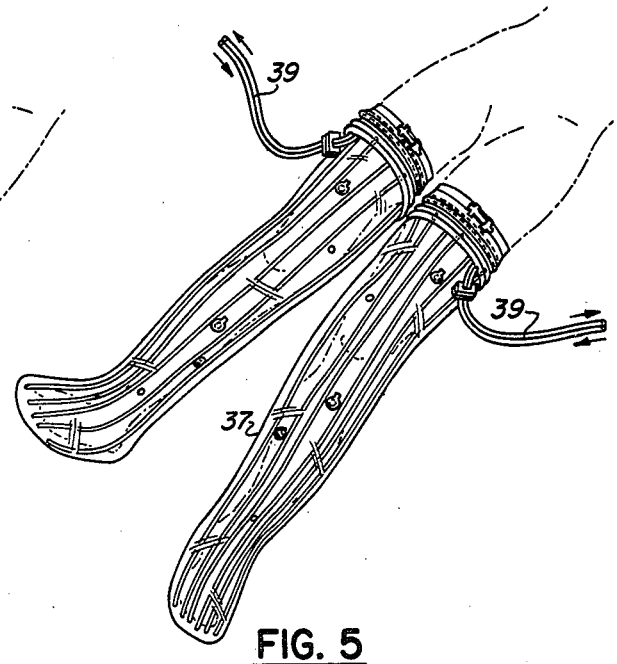
FIG. 5 is a perspective view showing both leg segments.

FIG. 2 and FIG. 3 show the attachment of the arm segments 23 to the body. FIG. 4 and FIG. 5 show the attachment of the leg segments 15 to the body. FIG. 1 shows the assembled plastic skin jacket or suit, 1. In connection, more particularly with the prospective shown in FIG. 1, arm and leg segments are shown joined to a torso segment 17. Liquid flow means, such as by a pump, 11, is also shown. The victim is inserted through the torso segment by way of torso entrance 189. Pull-tabs 187 are provided to allow opening of the entrance. Any entrance mechanism may be utilized which is known in the Art. Liquid which is pumped by way of pump unit 11, passes through connector box 19 and enters into tube 13 which delivers the liquid system through main distribution tubes 6 to secondary distribution tubes 153 (FIG. 2). The secondary distribution tubes are flat tubular members which are distributed throughout the various body segments. The tube is comprised of a plastic material and is perforated to allow the entering liquid to diffuse into the hollow cavity defined by the segment thereby bathing a particular portion of the body with the liquid. Liquid is withdrawn from the suit through the main out-take tube 149 (FIG. 2), ultimately returning to pump unit 11.

The plastic suit comprises a flexible transparent plastic material which is skin compatible, physiologically inert and chemical and water resistant. In a preferred embodiment, said plastic material comprises polyethylene although other plastic materials such as polyvinyl chloride and nylon, polyurethane and polypropylene may be utilized.

In the actual working embodiment of FIG. 1, the liquid first enters the torso segment bathing the victim's torso area with the desired liquid. The liquid flow separates from the main distribution tube 6 through the various connector boxes 7 into the main distribution tubes located in the arm segments, thereafter flowing through the secondary distribution tubes and out into the arm cavities through perforations in said secondary distribution in-take tubes. Ultimately, liquid flow is established in the leg segments through connector boxes 7, thereby resulting in bathing the entire body with the desired fluid. Alernatively, as shown in FIGS. 2, 3, 4 and 5, selected portions of the body, such as the arms and legs respectively can be utilized without the need of covering the entire body of the victim. Where no torso segment is utilized, a plastic segment to skin seal is required in order to make the segment water-tight and air-tight. A close up of that sealing mechanism is shown in FIG. 6.

The sealing means comprises a flexible plastic collar 43 containing a top area 45 and an inside area 47. The collar can be made of any plastic material but preferably the following materials are used: polyethylene and polyurethane. A flexible elastic plastic 59 connects the collor 43 to the garment segment 69. The elastic plastic preferrably comprises flexible polyurethane. As shown in FIG. 6, the body member, such as an arm, is inserted through the opening defined by collar 43, and passes through the opening defined by the elastic 59, entering into the hollow cavity defined by the garment segment 69. The flexibility of the elastic plastic 59 allows accomodation of varying sizes of body members. Tightening means are provided on the collar portion to permit securing of the collar to the limb thereby providing a water-tight and air-tight seal. The tightening means comprises an overlapping plastic strip 55 connecting the upper edge of the collar 43 to the lower edge of said collar thereby defining an opening between the surface of the collar and the underside of the overlapping plastic segment. A slit 53 appears in the collar and is situated just below the overlapping plastic segment 55. The slit extends from the upper edge of the collar and runs down to the lower edge of the collar at the point where said collar and the elastic plastic 59 join. The slit thereby creates two portions of the collar member 45. The elongated tab 49 is attached to the furthest removed segment of the collar, just beyond the slit. The tab is provided with nodes 81 to prevent slippage of the tab back through the opening defined by the plastic overlapping member 55. The underside of the tab 51 contains an adhesive material which is protected by a pull-off tab 83. The overlapping plastic strip 55 is provided with a gripping segment 57. In actual practice, the segment is positioned over the body member and plastic tab 49 is pulled to produce the desired opening diameter of collar 43. Pull-off tab 83 is removed with one hand while gripping segment 57 is held with the other hand. As pull-off tab 83 is removed, exposing the pressure sensative adhesive undercoating 51 of plastic tab 49, plastic tab 49 is simultaneously affixed to the plastic collar 43, whereupon a liquid-tight, air-tight seal is created between the body member and the plastic segment.

The surface of the plastic suit in FIG. 1 contains a series of entrances which afford a means of establishing penetration through the plastic skin. One of these entrances 3 permits the air-tight, water-tight instrusion of hypodermic needles and other devices of the like. This entrance 3 consists of a thin circular section of rubber, or other such self sealing materials, which is affixed to the plastic suit. Another entrance 5 permits application of, for example, electrodes or other sensors for use with, for example, electro-cardiogram techniques. It consists of a circular indented pull-off segment with a pull-off tab for easy removal. The third entrance 4 consists of a circular section of electrically conductive foil through which skin sensors can be applied.

Figure 6:
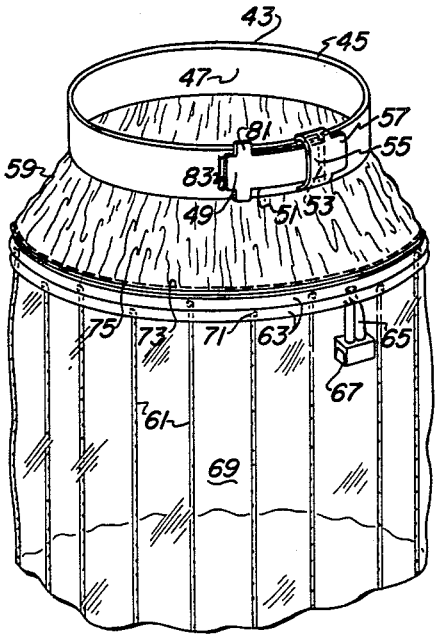
FIG. 6 is a perspective view of the limb-receiving sleeve end of a segment.

The main distribution tubes and the secondary distribution tubes are shown in more detail in FIG. 6. Thus, the main distribution tubes comprise, preferrably, two concentric, hollow, plastic rings 63, surrounding the garment segment 69 and situated below the garment-to-body sealing ring or collar 43. One of the rings provides liquid in-take while the other ring provides liquid out-take. A plurality of perforated distribution and out-take tubes 61 extend from and perpendicular to the two concentric rings 63 running throughout the length of the hollow cavity defined by the garment segment 69. In the event the garment segment does not attach directly to a body member but is attached to a torso segment, then the collar 43 and the elastic plastic segment 59 may be removed by way of the circular rip-off indentation 73, thereby exposing the circular garment-segment to garment-segment sealing ring 75. In this embodiment, and as shown more clearly in FIG. 6, everything above the dotted line 73 is torn off and discarded. The remaining garment segment and sealing ring may then be connected to a torso segment as shown in FIG. 1.

Figure 7:
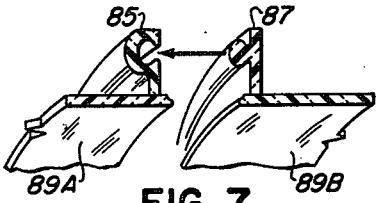
FIG. 7 is a perspective view of the segment-to-segment sealing means.
Figure 8:
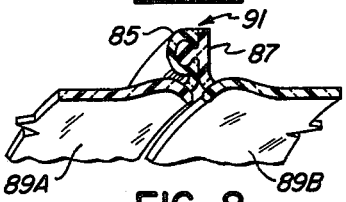
FIG. 8 is a perspective view of the segment-to-segment sealing means engaged.
Figure 9:
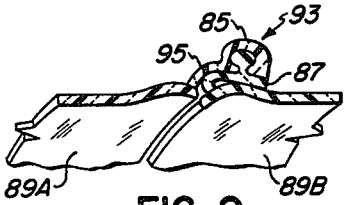
FIG. 9 is a perspective view of the segment-to-segment sealing means engaged, at rest position.

The sealing ring is shown in FIGS. 7 through 9. 89B represents, for example, the surface of the plastic garment segment just below the sealing ring 87. 89A represents the surface of another plastic garment segment such as the torso segment with its raised sealing ring 85. The raised surfaces 87 and 85 extend perpendicularly from said garment segment and run around the entire periphery thereof. With respect to raised surface 87, it is characterized by comprising a cylindrical projection running its entire length, said cylindrical member extending out from and substantially perpendicular to said raised surface. Raised surface 85 differs from raised surface 87 in that 85 contains a cylindrical depression running around the entire periphery of said garment segment, said depression being in a female-male relationship to said cylindrical projection, so that when raised surfaces 87 and 85 are brought into contact with each other, the cylindrical projection of 87 just fits into the cylindrical depression of raised surface of 85 thereby creating a water-tight, air-tight seal between the first garment segment and the torso segment brought into contact with it. FIG. 8 shows the interconnection of the two raised surfaces 91. In a preferred embodiment, the joined segments form a small raised flap which then folds over as shown in FIG. 9, resulting in a substantially smooth interface between the two joined segments. It is not a critical aspect of the instant invention as to whether the female or male sealing rings are situated on one particular garment segment or another segment; so long as there is a female-male relationship in each set of sealing mechanism that will suffice to create the desired sealing arrangement. In a preferred embodiment of the invention, all of the sealing raised surfaces would be in the male configuration on the torso segment while each of the limb segments such as the arms and legs, would be in the female mode.

The connector box as shown in FIGS. 1, 7, and FIGS, 4, 31, serve two functions: (1) As an interface between the plastic garment of the instant invention and liquid provision source such as pump means 11, to allow liquid to enter into the suit; (2) and as a joining mechanism to allow two segments to be in liquid flow relationship to each other such as shown in FIG. 1.

Figure 10:
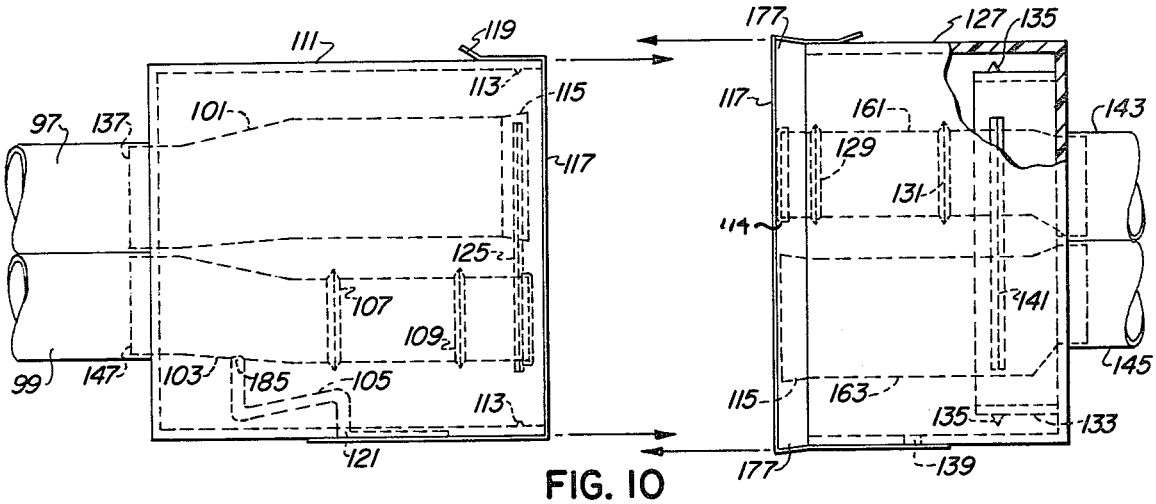
FIG. 10 is a plan view of the connector boxes.
Figure 11:
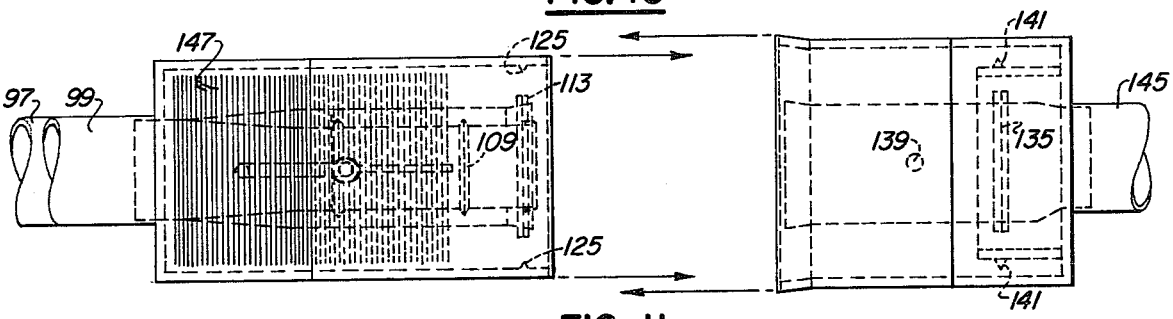
FIG. 11 is a side view of the connector boxes.
Figure 12:
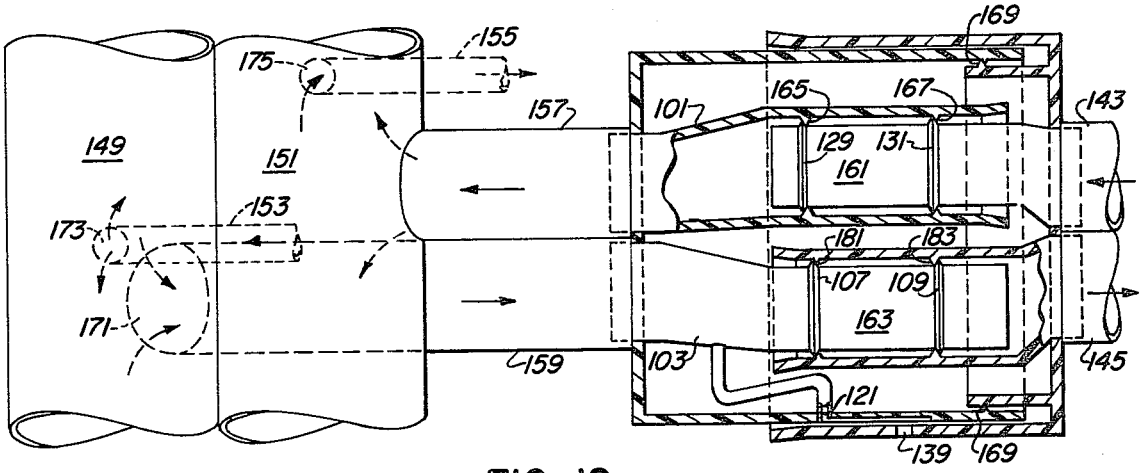
FIG. 12 is a plan view of the connector boxes in coupled position, as attached to the main distribution tubes.
Figure 13:
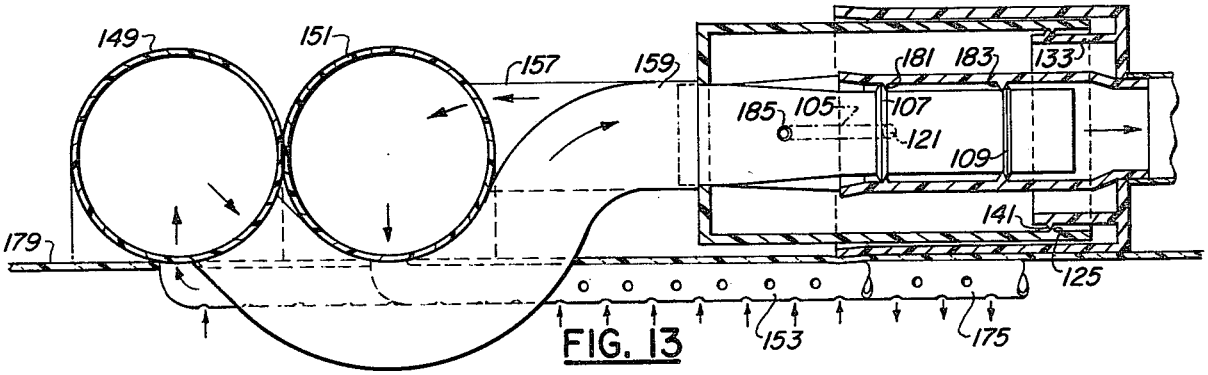
FIG. 13 is a side view of the connector boxes coupled, as connected to the main distribution tubes.

FIGS. 10 through 12 show a detailed perspective of the connector box of the instant invention. As shown in FIG. 10, the connector box comprises a larger rectangular member 127 and a smaller rectangular member 111, the width relationship of each being so disposed that connector box 111 upon being inserted into connector box 127, becomes releasably locked therein. Gripping surfaces 147 in FIG. 11 are provided on the surface of the connecting box to allow ease of engagement and disengagement of the respective boxes. The interior of the connector boxes are hollow and contain two cylindrical members consisting of an in-take plug 101 and an out-take plug 103. These are rigid plugs through which liquid enters into the suit and is ultimately withdrawn respectively. Counterparts of these two plugs are situated in the hollow cavity defined by connector box 127 and are designated 161 and 163 respectively. Plug 161 comprises a diameter which is somewhat smaller than plug 107, and plug 163 comprises a diameter which is somewhat larger than plug 103 in connector box 111. Thus, when connector boxes 111 and 127 are brought into an engagement or locking relationship, plug 161 fits into plug 101 and plug 103 fits into its counterpart plug 163 in connector box 127. Friction grip rings 129, 131, 107 and 109, as shown in FIG. 12, are situated on the exterior circumference of the smaller plugs to securely lock them into place within the larger plugs via gripping contact with friction grip rings 165, 167, 181 and 183 which are situated on the interior surface of the larger plugs as shown in FIG. 12. Locking of the larger and smaller connector boxes 111 and 127 respectively is accomplished by way of friction grips 135, 141 and 135 of the smaller box 127 as shown in FIG. 10 and friction grip ridge 125 of the larger connector box 111 as shown in FIG. 10.

As received from the manufacturer, the connector box openings will be provided with a protective seal 117 as shown in FIG. 10, the purpose of which is to maintain a sterile environment therein. Adhesive tab means 119 are provided on the protective covering to allow ease of removal when the connector boxes are to be put into use. In addition, each of the out-take plugs 101 and 161 come with a protective covering 114 to maintain the sterile environment within the plug itself and to prevent liquid from coming out when the plugs are not in use. When the rip-off seal 117 is removed, the plug covers are automatically removed thereby exposing the openings of the plugs and boxes for immediate use. 115 represents the plug flare. On the out-take plug 103, an air tube 105 is provided, joining the out-take plug at 185. The air tube is "s" shaped, running from the out-take plug to the surface of the connector box where it terminates at air opening 121 which permits air intrusion from the outside through the box opening. As delivered from the manufacturer, said air opening remains covered by protective seal 117, and is only exposed at the time that said protective covering is pulled off by tab means 119. The purpose of the air tube 105 is to prevent the collapsing of the plastic enclosure because of reduced air pressure from the vacuum out-take. The acute angularity between the first member of the "s" and the second member of the "s" tube is to prevent the leakage and outflow of liquid through the tube 105.

As shown in FIG. 10, joinder is facilitated by utilizing a beveled edge 177 on the larger connector box 127, as contrasted with the straight edges of the smaller connector box 111. The beveled edge 177 is to facilitate the joining of small connector box 111 to large connector box 127. Said in-take and out-take plugs extend beyond the rear of the box forming extender elements 137 and 147, said extender elements being connected to hollow tubular members 97 and 99 which connect said plugs, respectively, to the main distribution in-take tube and main distribution out-take tube, shown as 63 in FIG. 6. For clarity purposes, said connector tube members 97 and 99 are shown as tubular members 65 in FIG. 6.

FIG. 11 is a side view of the connector boxes as already described.

When the two connector boxes are joined together into flow relationship, a configuration is arrived at as shown in FIG. 11. Thus, plug 161 fits into plug 101 in locking relationship, caused by interaction of friction grips 165, 129, 167 and 131 as described hereinabove. Simultaneously, plug 103 fits into plug 163, being secured thereby by way of friction grips 181, 107, 183 and 109. The rectangular connector boxes are locked into place by way of friction ridges 169. The shapes of the respective connector boxes are designed so as to permit a small air channel between the boxes when they are in locking configuration, said air channel being established between opening 121 and opening 139. Liquid may now enter into the locked connector boxes through tubular member 143, flowing through plug 161 and 101 and exiting out the rear of connector box 111 into connector tube 167 which connects the connector box to the main distribution in-take tube 151. Liquid then travels through secondary perforated distribution tubes 155 through hole 175 (FIG. 12) and is thereafter distributed throughout the plastic segment as described previously and shown more clearly in FIG. 6. Liquid is withdrawn from the plastic segment through secondary out-take tube 153, exiting from said tube 153 through hole 173 and into the main out-take tube 149 where it enters through hole 171 into out-take connector tube 159. Thereafter, the out-take flow is withdrawn through 103, exiting the connector box through out-take tube 145.

FIG. 12 represents the side view of the connector box apparatus as depicted in FIG. 11. The secondary inlet and outlet tubes are shown clearly as 153 and 175 respectively. The surface of the plastic garment segment is shown as 179 with the concentric main distribution tubes 149 and 151 situated on the exterior of the suit; perforations or holes in the secondary in-take and outlet tubes are also shown.

The connector boxes may be separated by merely pulling them apart utilizing the circumscribed exterior friction grip 147 (FIG. 11). In the event the plastic garment segments are utilized only to protect the injured limb until other treatment can be rendered, i.e.—liquid flow is not required to bathe the damaged limb, then the connector boxes would not be used and would therefore remain in an unused configuration as shown in FIG. 6. In the unused mode, the boxes are fastened to the exterior of the segment by means of a light pressure sensitive adhesive under the connector box. The box need only be lifted free from the segment to be placed into use.

As depicted hereinabove, the garment of the instant invention finds particular use in connection with burn victims in that it provides an immediate covering, encapsulation and isolation of the wounded area and allows therapeutic bathing of the burn area at the site of the injury and during transportion. In another mode, the instant invention finds utility in the context of bedside treatment of burn victims without requiring their movement from one area of the hospital to another. Furthermore, the light weight flexible nature of the garments of the instant invention, allows them to be stored in a very minimal area. Coupled with the use of the inexpensive plastic materials to fabricate the garments of the instant invention, the subject invention features the aspect of disposability which other Prior Art treatment systems do not provide. The invention has the capability and quality of being completely portable and operational in the field such as for immediate use, for example, by emergency personnel in field hospitals.

Having set forth the subject invention, what is claimed is:

1. In the treatment of injured body members, a protective garment segment made of a flexible, water-resistant, plastic material which is skin compatible; said protective garment segment defining an elongated hollow cavity adapted to surround a body member inserted therein; said garment segment comprising a closed end and a limb-receiving sleeve end through which a body member can be inserted; said sleeve end comprising a garment-to-body sealing ring to permit a water/air-tight seal between the garment segment and the body member inserted therein, flexible elastic plastic to permit accomodation of the sleeve to different-sized body members, and means for disconnecting said sealing ring and said elastic plastic from said sleeve end, thereby exposing a garment-to-garment sealing ring, designed to permit water/air-tight joinder of said garment segment to a second garment segment brought into contact therewith.

2. The garment segment of claim 1 wherein pump means are provided for introducing liquid flow into said garment segment; distribution means are provided for distributing said liquid flow throughout said garment thereby uniformly bathing said body member in said liquid; and removal means are provided for removing said liquid from said garment segment.

3. The garment segment of claim 2 wherein the liquid distribution means comprises two concentric hollow plastic rings surrounding the garment segment and situated below and in close proximity to the garment-to-garment sealing ring, one ring providing liquid in-take and the other ring providing liquid out-take; and a plurality of perforated flexible distribution and out-take tubes, extending from and substantially perpendicular to the two concentric rings and running throughout the length of the hollow cavity of the garment segment, whereby liquid entering an in-take ring by said pump means, is distributed throughout the hollow cavity by means of said perforated in-take distribution tubes, said liquid being removed from the hollow cavity through said out-take tube and out-take ring.

4. In the treatment of injured body members, a protective garment segment made of a flexible, water-resistant, plastic material which is skin compatible; said protective garment segment defining an elongated hollow cavity adapted to surround a body member inserted therein; said garment segment comprising a closed end and a limb-receiving sleeve end through which a body member can be inserted; said sleeve end comprising a garment-to-body sealing ring to permit a water/air-tight seal between the garment segment and the body member inserted therein, flexible elastic plastic to permit accomodation of the sleeve to different-sized body member, and means for disconnecting said sealing ring and said elastic plastic from said sleeve end, thereby exposing a garment-to-garment sealing ring, designed to permit water/air-tight joinder of said garment segment to a second garment segment brought into contact therewith, said garment-segment to garment-segment sealing ring comprising a raised surface extending substantially perpendicularly from said garment segment and running around the periphery of said garment segment; said raised surface further characterized by containing a cylindrical projection running its entire length, said cylindrical projection extending out from and substantially perpendicularly to said raised surface.

5. The sealing ring of claim 4 wherein said sealing ring is brought into contact with a sealing ring from a second garment segment, said second garment segment sealing ring differing from said first garment segment sealing ring in that the raised surface contains a cylindrical depression running around the periphery of said garment segment in lieu of said cylindrical projection, said cylindrical depression being in a female-male relationship to said cylindrical projection of said first garment segment raised surface, whereby when said first and second raised surfaces are brought into contact with each other and pressure is applied thereto, said cylindrical projection fits into said cylindrical depression thereby creating a water-tight seal between said first and second garment segments.

6. In the treatment of injured body members, a protective garment segment made of a flexible, water-resistant, plastic material which is skin compatible; said protective garment segment defining an elongated hollow cavity adapted to surround a body member inserted therein; said garment segment comprising a closed end and a limb-receiving sleeve end through which a body member can be inserted; said sleeve end comprising a garment-to-body sealing ring to permit a water/air-tight seal between the garment segment and the body member inserted therein, flexible elastic plastic to permit accomodation of the sleeve to different-sized body members, and means for disconnecting said sealing ring and said elastic plastic from said sleeve end, thereby exposing a garment-to-garment sealing ring, designed to permit water/air-tight joinder of said garment segment to a second garment segment brought into contact therewith, said garment-to-body sealing ring comprising a plastic collar containing top and bottom edges; an overlapping plastic strip protruding out of the plane of the collar and extending from the top edge of the collar to the bottom edge thereof thereby defining an opening between the collar surface and the plastic strip; a gripping segment attached to and incorporated in said overlapping strip; a slit in the collar extending from the top edge to the bottom edge of said collar and terminating at the point where said bottom edge of said collar meets with said elastic plastic, said slit being situated in that portion of the collar which lies underneath the overlapping plastic strip, whereby said collar is divided into two segments separated at the top edge but joined at the bottom edge; an elongated plastic member comprising an adhesive-containing end containing a protective tab which covers said adhesive, the other end of said elongated member being attached to the segment of the collar furthese removed from said adhesive end, said elongated member extending from said collar segment through the opening defined by the overlapping plastic strip, whereby when said elongated member is pulled, the circumference of the collar is decreased thereby adjusting the opening of the limb-receiving sleeve to accomodate varying sizes of body limbs; and locking in the desired collar circumference by removing said protective tab covering said adhesive area on the underside of the elongated member, and pressing said elongated member and collar together thereby creating a seal between said elongated member and said collar.

7. In the treatment of injured body members, a protective garment segment made of a flexible, water-resistant, plastic material which is skin compatible; said protective garment segment defining an elongated hollow cavity adapted to surround a body member inserted therein, and where pump means are provided for introducing liquid flow into said garment segment, distribution means are provided for distributing said liquid flow throughout said garment thereby uniformly bathing said body member in said liquid, and removal means are provided for removing said liquid from said garment segment, said liquid distribution means comprising two concentric hollow plastic rings surrounding the garment segment and situated below and in close proximity to a garment-to-garment sealing ring, one ring providing liquid intake and the other ring providing liquid outtake, and a plurality of perforated flexible distribution and outtake tubes, extending from and substantially perpendicular to the two concentric rings and running throughout the length of the hollow cavity of the garment segment, whereby liquid entering an intake ring by said pump means, is distributed throughout the hollow cavity by means of the said perforated intake distribution tubes, said liquid being removed from the hollow cavity through said out-take tube and out-take ring; said garment segment comprising a closed end and a limb-receiving sleeve end through which a body member can be inserted; said sleeve end comprising a garment-to-body sealing ring to permit a water/air-tight seal between the garment segment and the body member inserted therein, flexible elastic plastic to permit accomodation of the sleeve to different-sized body members, and means for disconnecting said sealing ring and said elastic plastic from said sleeve end, thereby exposing a garment-to-garment sealing ring, designed to permit water/air-tight joinder of said garment segment to a second garment segment brought into contact therewith, said liquid distribution means further comprising a connector box extending from and attached to said concentric hollow plastic rings of said first garment segment by means of connector tubes and wherein said connector box comprises a rectangular housing defining a hollow cavity containing two rigid, hollow, cylindrically-shaped liquid flow plugs situated side-by-side extending from said connector tubes and terminating within said housing, one of said flow plugs being slightly larger than the other flow plug and wherein said flow plugs are used for introducing liquid into and withdrawing liquid from said plastic rings.

8. The connector box of claim 7 wherein said connector box is adapted to fit into a second connector box situated on a second garment segment, said second connector box comprising a rectangular housing of slightly smaller dimensions then that of the first connector box, said housing defining a hollow cavity comprising two rigid hollow, cylindrically-shaped flow plugs situated side-by-side, of identical dimensions to the flow plugs of the first connector box but bearing a reversed positioning relative thereto, so that upon insertion of the second connector box into the first connector box, the smaller plug fits into the larger plug of the first box, while the larger plug fits over the smaller plug of the first connector box; said first and second connector boxes also comprising locking means whereby said boxes become releasably locked when they are inserted into each other, thereby creating a water and air-tight seal enabling liquid flowing through one garment segment to enter and flow through a second garment segment.

9. The connector box of claim 7 wherein the open end thereof is provided with a removable covering for use when the connector box is not utilized, whereby said connector box is rendered liquid and air-tight.

10. The garment segment of claim 1 wherein the surface of the segment contains a plurality of entrance means.

11. The liquid distribution means of claim 4 further comprising a connector box extending from and attached to said concentric hollow plastic rings of said first garment segment by means of connector tubes and wherein said connector box comprises a rectangular housing defining a hollow cavity containing two rigid, hollow, cylindrically-shaped liquid flow plugs situated side-by-side extending from said connector tubes and terminating within said housing, one of said flow plugs being slightly larger than the other flow plug and wherein said flow plugs are used for introducing liquid into and withdrawing liquid from said plastic rings.

12. The connector box of claim 11 wherein said connector box is adapted to fit into a second connector box situated on a second garment segment, said second connector box comprising a rectangular housing of slightly smaller dimensions then that of the first connector box, said housing defining a hollow cavity comprising two rigid, hollow, cylindrically-shaped flow plugs situated side-by-side, of identical dimensions to the flow plugs of the first connector box but bearing a reversed positioning relative thereto, so that upon insertion of the second connector box into the first connector box, the smaller plug fits into the larger plug of the first box, while the larger plug fits over the smaller plug of the first connector box; said first and second connector boxes also comprising locking means whereby said boxes become releasably locked when they are inserted into each other, thereby creating a water and airtight seal enabling liquid flowing through one garment segment to enter and flow through a second garment segment.

13. In the treatment of injured body members, a protective garment segment made of a flexible, water-resistant, plastic material which is skin compatible; said protective garment segment defining an elongated hollow cavity adapted to surround a body member inserted therein; said garment segment comprising a closed end and a limb-receiving sleeve end through which a body member can be inserted; said sleeve end comprising a garment-to-body sealing ring to permit a water/air-tight seal between the garment segment and the body member inserted therein, flexible elastic plastic to permit accomodation of the sleeve to different-sized body members, and means for disconnecting said sealing ring and said elastic plastic from said sleeve end, thereby exposing a flexible garment-to-garment sealing ring, designed to permit water/air-tight joinder of said garment segment to a second garment segment brought into contact therewith.

14. The garment segment of claim 13 wherein pump means are provided for introducing liquid flow into said garment segment; distribution means are provided for distributing said liquid flow throughout said garment thereby uniformly bathing said body member in said liquid; and removal means are provided for removing said liquid from said garment segment.

15. The garment segment of claim 14 wherein the liquid distribution means comprises two concentric hollow plastic rings surrounding the garment segment and situated below and in close proximity to the garment-to-garment sealing ring, one ring providing liquid in-take and the other ring providing liquid out-take; and a plurality of perforated flexible distribution and out-take tubes, extending from and substantially perpendicular to the two concentric rings and running throughout the length of the hollow cavity of the garment segment, whereby liquid entering an in-take ring by said pump means, is distributed throughout the hollow cavity by means of said perforated in-take distribution tubes, said liquid being removed from the hollow cavity through said out-take tube and out-take ring.

16. In the treatment of injured body members, a protective non-inflatable garment segment made of a flexible, water-resistant, plastic material which is skin compatible; said protective garment segment defining an elongated hollow cavity adapted to surround a body member inserted therein; said garment segment comprising a closed end and a limb-receiving sleeve end through which a body member can be inserted; said sleeve end comprising a garment-to-body sealing ring to permit a water/air-tight seal between the garment segment and the body member inserted therein, flexible elastic plastic to permit accomodation of the sleeve to different-sized body members, and means for disconnecting said sealing ring and said elastic plastic from said sleeve end, thereby exposing a flexible garment-to-garment sealing ring, designed to permit water/air-tight joinder of said garment segment to a second garment segment brought into contact therewith.

17. The garment segment of claim 16 wherein pump means are provided for introducing liquid flow into said garment segment; distribution means are provided for distributing said liquid flow throughout said garment thereby uniformly bathing said body member in said liquid; and removal means are provided for removing said liquid from said garment segment.

18. The garment segment of claim 17 wherein the liquid distribution means comprises two concentric hollow plastic rings surrounding the garment segment and situated below and in close proximity to the garment-to-garment sealing ring, one ring providing liquid in-take and the other ring providing liquid out-take; and a plurality of perforated flexible distribution and out-take tubes, extending from and substantially perpendicular to the two concentric rings and running throughout the length of the hollow cavity of the garment segment, whereby liquid entering an in-take ring by said pump means, is distributed throughout the hollow cavity by means of said perforated in-take distribution tubes, said liquid being removed from the hollow cavity through said out-take tube and out-take ring.

* * * * *